US008844331B2

(12) United States Patent
Golovashchenko

(10) Patent No.: US 8,844,331 B2
(45) Date of Patent: Sep. 30, 2014

(54) ELECTRO-HYDRAULIC FORMING PROCESS WITH ELECTRODES THAT ADVANCE WITHIN A FLUID CHAMBER TOWARD A WORKPIECE

(75) Inventor: Sergey Fedorovich Golovashchenko, Beverly Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 554 days.

(21) Appl. No.: 12/915,110

(22) Filed: Oct. 29, 2010

(65) Prior Publication Data

US 2012/0103045 A1 May 3, 2012

(51) Int. Cl.

| | |
|---|---|
| ***B21D 22/10*** | (2006.01) |
| ***B21D 26/02*** | (2011.01) |
| ***B23P 17/00*** | (2006.01) |
| ***B21D 26/12*** | (2006.01) |

(52) U.S. Cl.

CPC ..... *B21D 26/12* (2013.01)
USPC ..... 72/60; 72/56; 29/421.2

(58) Field of Classification Search

USPC ..... 72/54, 60, 57, 430, 706, 56; 29/421.1
See application file for complete search history.

(56) References Cited

U.S. PATENT DOCUMENTS

| | | | | |
|---|---|---|---|---|
| 3,267,710 | A * | 8/1966 | Inoue | 72/56 |
| 3,572,072 | A * | 3/1971 | Hundley et al. | 72/56 |
| 3,593,551 | A | 7/1971 | Roth et al. | |
| 3,640,110 | A | 2/1972 | Inoue | |
| 3,668,365 | A | 6/1972 | Norin et al. | |
| 4,292,491 | A | 9/1981 | Tanaka et al. | |
| 6,227,023 | B1 | 5/2001 | Daehn et al. | |
| 7,516,634 | B1 | 4/2009 | Golovashchenko et al. | |
| 7,802,457 | B2 * | 9/2010 | Golovashchenko et al. | 72/56 |

OTHER PUBLICATIONS

Paderborn University, Paderborn, Germany, Investigation of the Electrohydraulic Forming Process with respect to the Design of Sharp Edged Contours, W. Homberg, C. Beerwald, A. Probsting, 2010.

* cited by examiner

*Primary Examiner* — Shelley Self
*Assistant Examiner* — Mohammad I Yusuf
(74) *Attorney, Agent, or Firm* — Damien Porcari; Brooks Kushman P.C.

(57) ABSTRACT

A system for electro-hydraulically forming a sheet metal part in an electro-hydraulic forming (EHF) machine. The part in a first shape is placed in the EHF machine between a one-sided forming die and a chamber that is filled with a liquid. An electrode is discharged in the chamber to form the part toward the forming die. The electrode is advanced within the chamber toward the part and a subsequent discharge is provided in the chamber to form the part. A gap discharge EHF machine and a wire discharge EHF machine may be used in the system.

6 Claims, 7 Drawing Sheets

ELECTRO-HYDRAULIC FORMING PROCESS WITH ELECTRODES THAT ADVANCE WITHIN A FLUID CHAMBER TOWARD A WORKPIECE

STATEMENT REGARDING FEDERALLY SPONSORED RESEARCH OR DEVELOPMENT

The invention was made with Government support under Contract No. DE-FG36-08GO1828. The Government has certain rights to the invention.

BACKGROUND

1. Technical Field

This application relates to electro-hydraulic forming processes and machines that are used to progressively form metal panels.

2. Background Art

Electro-hydraulic forming (EHF) is performed by providing a high voltage discharge in a liquid filled chamber that is directed toward a work piece such as a blank or a pre-formed panel. The work piece is formed into a one-sided die by the high voltage discharge.

One type of machine for EHF utilizes two electrodes that are connected to a bank of capacitors and assembled through the walls of a chamber that contains the liquid. This process may be referred to the gap discharge process. Some of the problems associated with a gap discharge process are that the electrodes erode, and the insulation may crack after several discharges. The electrodes require periodic maintenance and adjustment to compensate for electrode erosion and cracks in the insulation. As the quantity of energy discharged through the chamber increases, erosion of the electrodes and fracture of the insulation become more pronounced.

Another type of machine for EHF utilizes a thin wire that is placed in a liquid chamber and is connected between two electrodes. This process may be referred to as a wire discharge process. Some of the problems associated with the wire discharge process are that the wire must be replaced after each discharge, and the wire may weld to one of the electrodes or wire holders. The position of the wire is established relative to the initial position of the work piece.

The spacing between the electrodes and the work piece is either fixed or may increase if sequential discharges are used in a forming process. If sequential or multiple discharges are required to form a work piece, the distance between the wires and the work piece increases with each sequential discharge. As the distance increases, the power of the discharge decreases.

The volume of fluid in the chamber also increases due to the need to refill the chamber after each discharge. As the volume of fluid increases, the power of the discharge also decreases.

Applicant's disclosure addresses the above problems associated with electro-hydraulic forming as summarized below.

SUMMARY

A system for electro-hydraulically forming a sheet metal part in an electro-hydraulic forming (EHF) machine in which at least one electrode is advanced toward the part to be formed between sequential discharges. A partially formed part having a first shape is formed to a second shape by a first discharge. The electrode or a second electrode is advanced with a liquid filled chamber toward the part and then a second or subsequent discharge forms the part into a third, or final, shape. The volume of liquid required to fill the chamber is reduced by advancing the electrode assembly into the chamber.

A gap discharge electro-hydraulic forming (EHF) machine for forming a part comprises a chamber defining an opening, a fluid contained in the chamber and a one-sided forming die that is assembled to the chamber with the part disposed between the chamber and the die. An electrode assembly includes a body that is received in the opening, a first electrode that is assembled to the body and a second electrode that is assembled to the body and is spaced from the first electrode. A gap is defined between the two electrodes. A circuit is connected to the first and second electrodes that creates a potential voltage difference between the electrodes that may be selectively discharged across the gap. The spacing between the electrode assembly and the part may be changed by moving the body relative to the chamber to vary the intensity of the force applied to the part when the circuit is discharged across the gap. In addition, a reduced volume of liquid is required to fill the chamber by advancing the electrode assembly inside the chamber.

A wire electrode electro-hydraulic forming (EHF) machine comprises a chamber defining an opening, a fluid contained in the chamber, and a one-sided forming die that is assembled to the chamber with the part disposed between the chamber and the die. An electrode assembly includes a first holder and a second holder and a wire electrode electrically connected to the first and second holders. A first lifter and a second lifter are operatively connected to the first and second holders, respectively. The lifters raise and lower the wire electrode within the chamber and relative to the part to change the distance between the wire electrode and the part. The intensity of force applied to the part by an electro-hydraulic discharge of the wire electrode is controlled by changing the distance between the wire electrode and the part and the volume of fluid contained in the chamber.

These and other aspects of the applicant's disclosure will be better understood by one of ordinary skill in the art in view of the attached drawings and detailed description of the disclosed embodiments.

DETAILED DESCRIPTION

Figure 1:
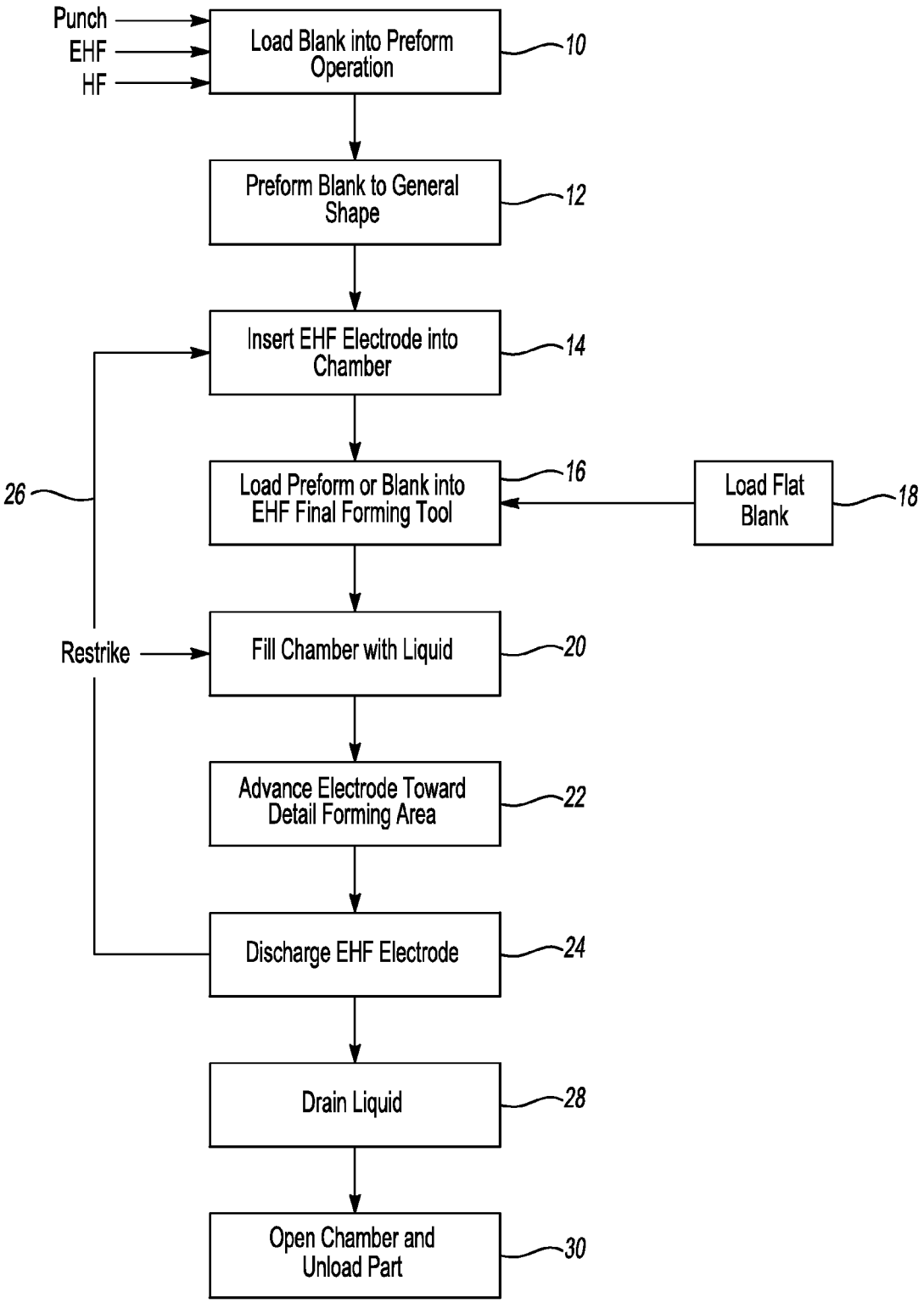
FIG. 1 is a flowchart of a process for electro-hydraulic forming parts in sequential steps whereby different embodiments of EHF tools may be used to practice Applicant's concept.

Referring to FIG. 1, a flowchart is provided that illustrates the general steps for electro-hydraulically forming a part that discloses several different alternative embodiments. In one embodiment of the invention, a blank may be loaded into a pre-form operation where the blank is pre-formed by conventional sheet metal punch press operation, an electro-hydraulic forming operation or a hydro-forming operation.

The blank is loaded into a tool for one of the forming operations at 10. The blank is then pre-formed to a general shape at 12 in the respective forming operation. An electro-hydraulic forming chamber is prepared for the next step by inserting the electro-hydraulic forming electrode into a chamber at 14. The pre-formed blank formed at 12 is then loaded into the electro-hydraulic forming tool for final forming at 16. An alternative embodiment illustrated in FIG. 1 is that a flat blank may be loaded at 18 into the electro-hydraulic forming tool. The electrode for the electro-hydraulic forming process is inserted into the chamber at 14 before the pre-form or blank is loaded into the EHF final forming tool.

The chamber is then filled with liquid, such as water, including a rust preventative, at 20. The electrode is then advanced toward an area that is to be formed with greater detail at 22. The electro-hydraulic forming tool electrode is discharged at 24. The process may be repeated in a re-strike operation returning at loop 26. If the electro-hydraulic forming electrode is of the wire electrode type, the process returns to 14 with insertion of a new wire electrode into the chamber. The process is then repeated until the part is formed to the required degree of detail. Alternatively, if the electro-hydraulic forming electrode is a gap electrode, the re-strike loop returns to 20 wherein the chamber is filled again with liquid to fill the space created below the blank by the electro-hydraulic forming charge. The gap electrode is advanced at 22 and the electrode is discharged again at 24 until the part is completely formed. The liquid is then drained from the chamber at 28 and the chamber is opened at 30 to unload the part.

Figure 2:
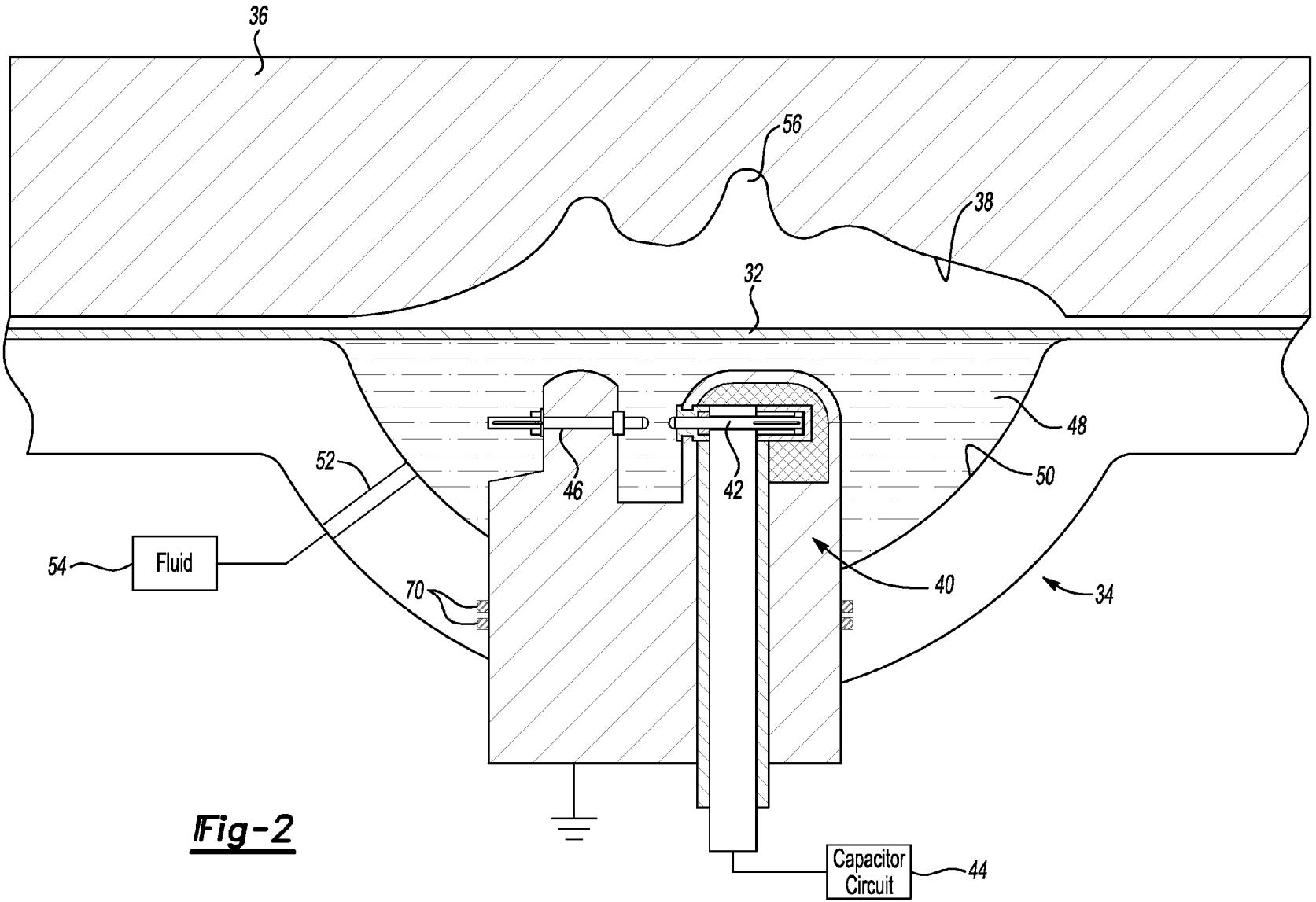
FIG. 2 is a diagrammatic cross-sectional view of a gap discharge EHF tool in which a blank has been loaded and is ready for EHF forming.

Referring to FIG. 2, a blank 32 is shown in a gap discharge EHF machine 34 that is disposed adjacent to a single sided die 36 that defines a die cavity 38 into which the blank 32 is to be formed. A gap discharge electrode assembly 40 is shown below the blank 32. The gap discharge electrode assembly 40 includes a charge carrying electrode 42 that is coupled to a stored charge circuit or capacitor circuit 44. A grounded electrode 46 cooperates with the charge carrying electrode 42. Alternatively, instead of using a grounded electrode 46, an opposite polarity electrode could be provided to cooperate with the charge carrying electrode 42.

A fluid 48 is supplied to the EHF chamber 50 through a fluid channel 52 from a fluid supply source 54. A space 56 is created between the blank and the die cavity 38.

Figure 3:
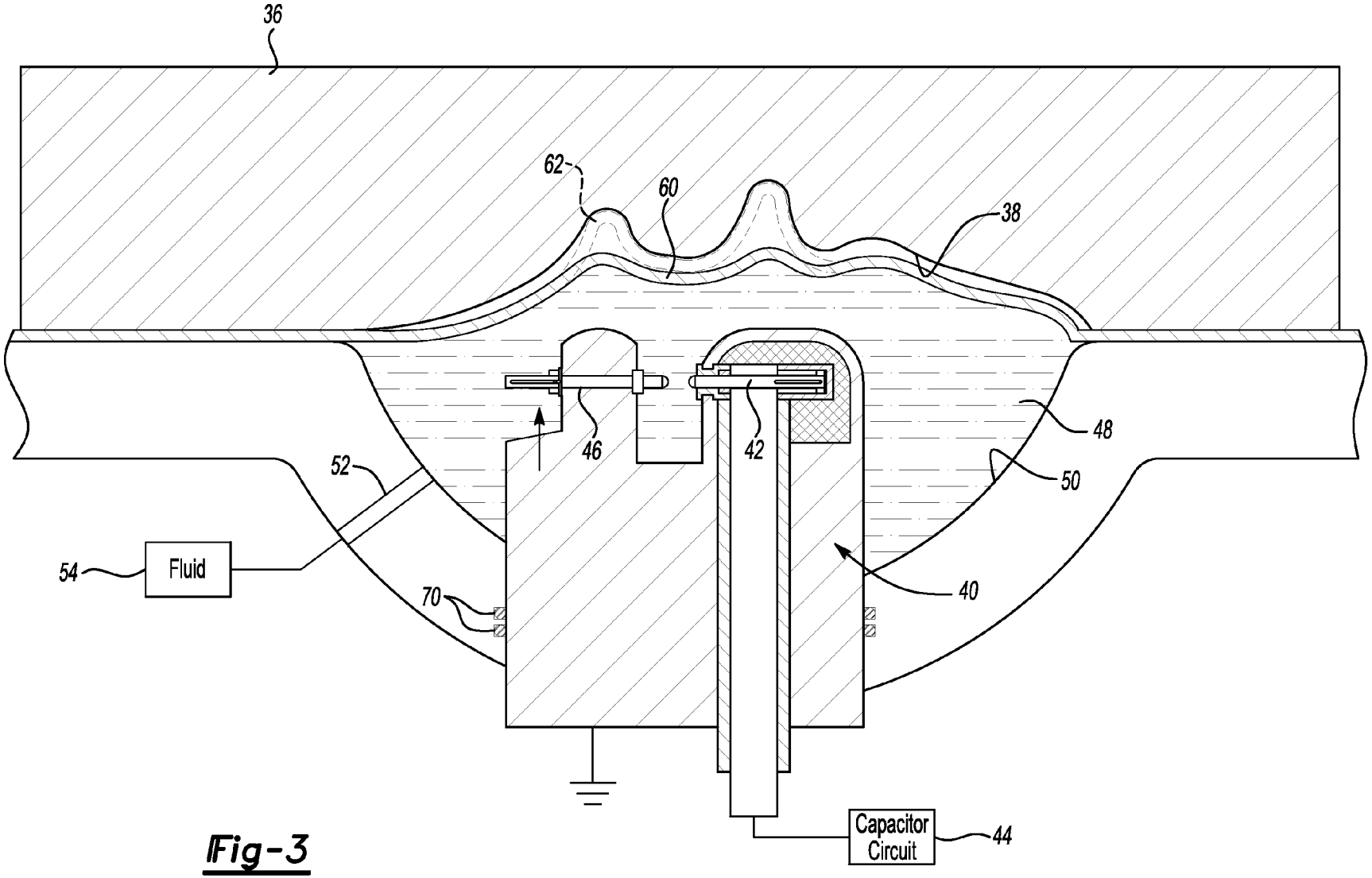
FIG. 3 is a diagrammatic cross-sectional view of the EHF tool shown in FIG. 2 shown prior to a final forming operation with the blank being formed into an intermediate shape and with the electrode being advanced toward the detail areas to be formed in a second or subsequent EHF forming operation.

Referring to FIG. 3, a partially formed part 60 is shown to be partially formed from the blank 32 after the gap discharge electrode assembly 40 is discharged in FIG. 2. A fully formed part 62 is shown in phantom lines to illustrate the result of the second, or subsequent, sequential forming step wherein the electrode assembly 40 has been discharged a second time to form the fully formed part 62 from the partially formed part 60. In the forming step shown in FIG. 3, the electrode assembly 40 is advanced further into the chamber 50 as indicated by the diagrammatic arrow to the left side of electrode assembly 40 in FIG. 3 toward the partially formed part 60. The fluid 48 in the chamber 50 has been further filled, but due to the movement of the electrode assembly 40 toward the partially formed part, less fluid is required to be added to the chamber and the spacing between the electrode assembly 40 and the partially formed part 60 is reduced. By reducing the spacing and using less fluid 48, greater force may be applied to the partially formed part 60 to form the fully formed part 62.

Referring to FIGS. 2 and 3, a seal 70 is provided between the gap discharge electrode assembly 40 and the EHF chamber 50 to seal the chamber and prevent leakage of the fluid 48 around the electrode assembly 40.

Figure 4:
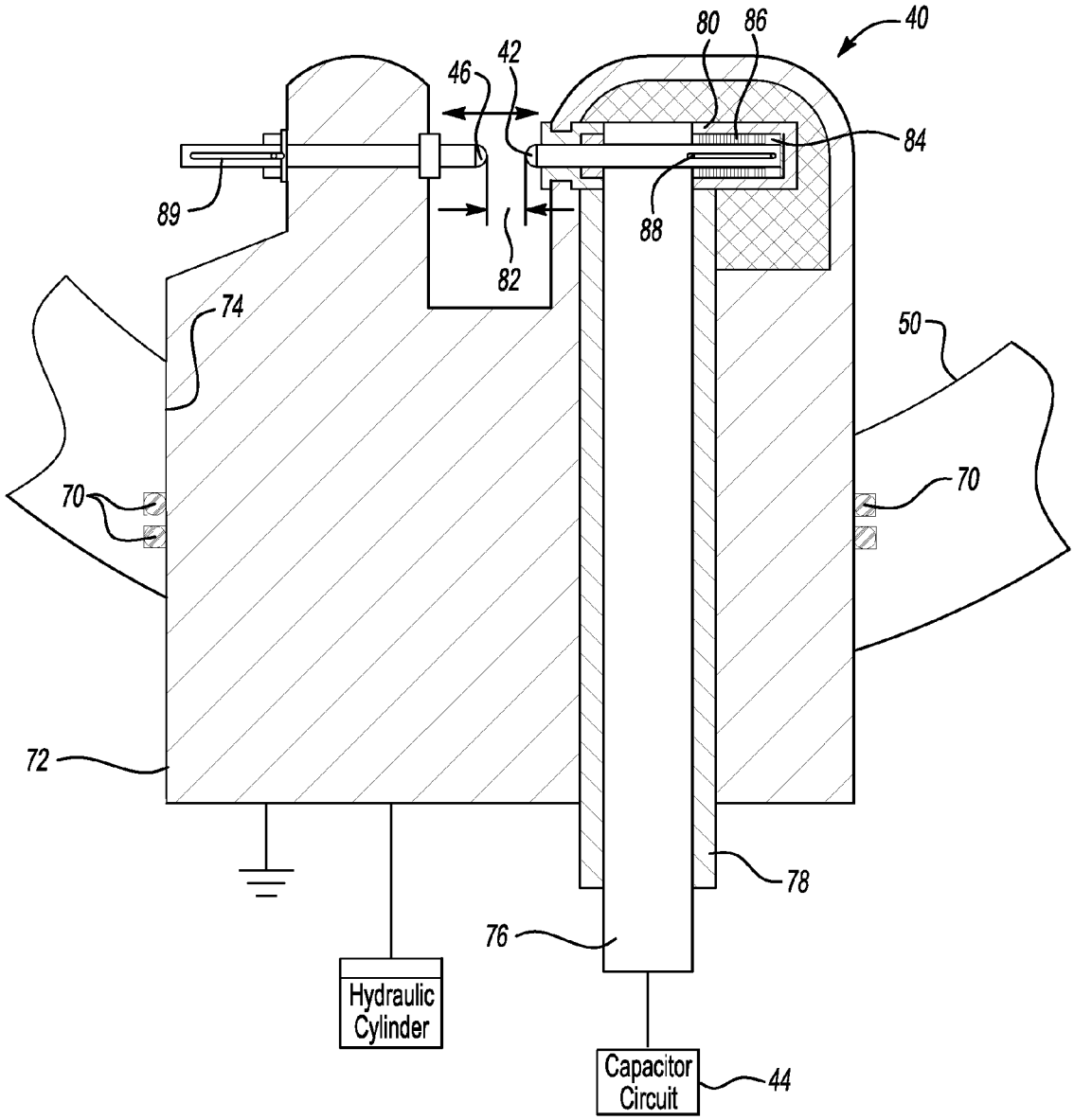
FIG. 4 is a fragmentary cross-sectional view of an EHF forming tool showing a gap discharge electrode assembly that may be advanced as shown in FIGS. 2 and 3.

Referring to FIG. 4, the gap discharge electrode assembly 40 is shown in greater detail. The assembly includes an electrode body 72 that is inserted through the EHF chamber 50 and is movable into and out of the chamber 50. Alternatively, it should be understood that the grounded electrode 46 may also be recessed within the electrode body 72. The charge carrying electrode 42 in the illustrated embodiment is electrically connected to a conductor 76. The conductor 76 is insulated from the electrode body 72 by an insulator sleeve 78. A tip insulator 80 is assembled around the charge carrying electrode 42.

A gap 82 is defined between the charge carrying electrode 42 and the grounded electrode 46. When the capacitor circuit 44 is discharged, a high voltage discharge occurs across the gap 82. The size of the gap may be adjusted by a nut 84 and spacers 86 that retain the charge carrying electrode 42 in position in the electrode body 72 and thereby maintain the proper gap between the charge carrying electrode 42 and the grounded electrode 46. An anti-rotation slot 88 may be provided in the charge carrying electrode 42 that prevents the electrode from rotating as a result of the force of the discharge. Another anti-rotation slot 89 may be provided on the grounded electrode 46 to prevent the grounded electrode 46 from rotating as a result of the discharge. The electrode assembly 40 may be advanced by a mechanical or hydraulic mechanism, such as a hydraulic cylinder, (not shown) that is capable of advancing and retracting the electrode assembly 40 relative to the EHF chamber 50.

Figure 5:
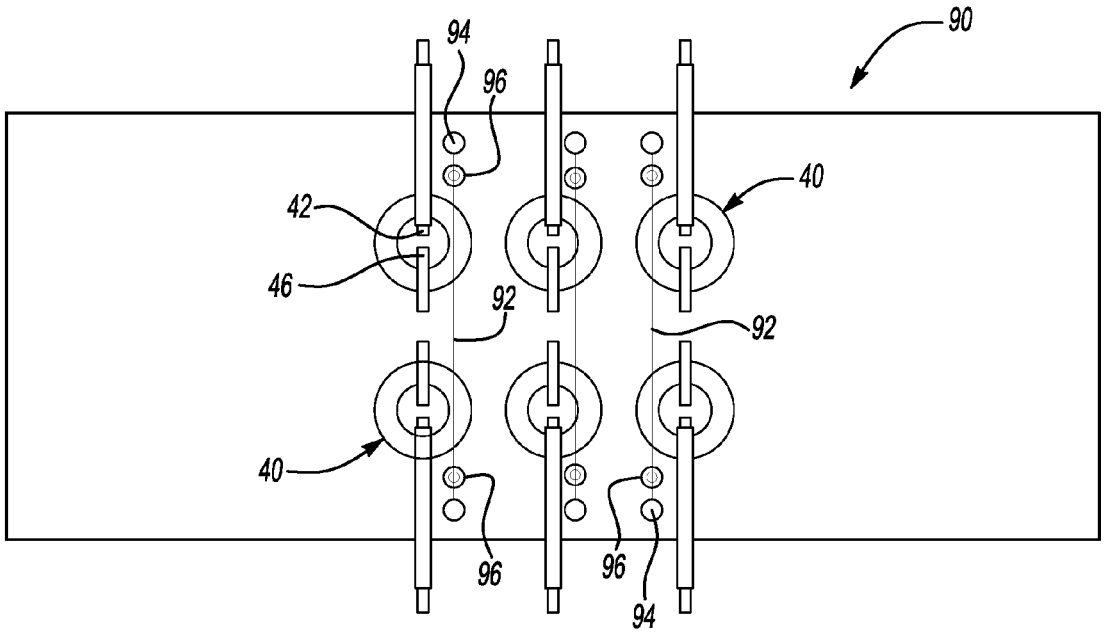
FIG. 5 is a plan view of a combined gap discharge EHF tool and a wire discharge EHF tool.

Referring to FIG. 5, a combination electrode assembly 90 is shown that includes a wire electrode 92 that is attached to wire electrode holders 94. An electrode rod 96 works in conjunction with the wire electrode holder 94 to provide current to the wire electrode 92 within the forming chamber 50. The electrode rod 96 is an electrode that is electrically connected to the electrode wire 92. A plurality of gap discharge electrodes are also shown in FIG. 5 that include a charge carrying electrode 42 and a grounded electrode 46 as described with reference to FIGS. 2-4 above. The combination of electrode assemblies shown in FIG. 5 in plan view are shown in diagrammatic cross-sectional elevation views in FIGS. 6-8.

Figure 6:
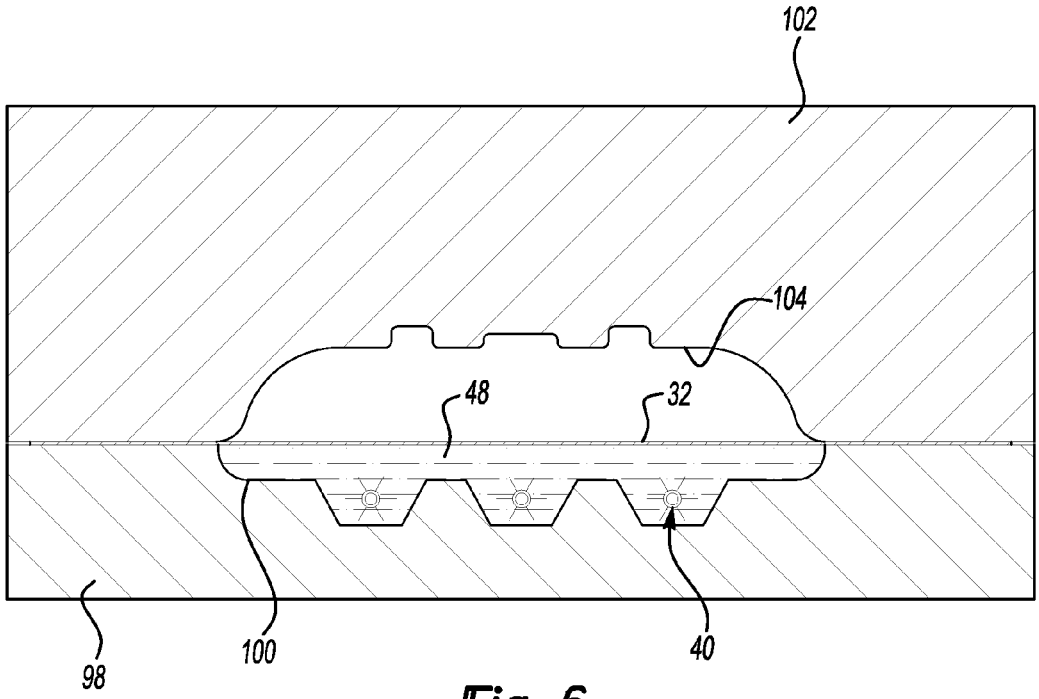
FIGS. 6-8 are diagrammatic sequential views showing the combined EHF tool of FIG. 5 in an initial, intermediate and final forming step.

Referring to FIG. 6, the blank 32 is shown disposed on a lower tool 98. A chamber 100 is defined between the blank 32 and the lower tool 98. An upper tool 102 is disposed above the lower tool 98 and includes a die surface 104 toward which the blank 32 is formed when a gap discharge electrode assembly 40 is discharged within the chamber 100. The chamber 100 is filled with a fluid 48 as previously described.

Figure 7:
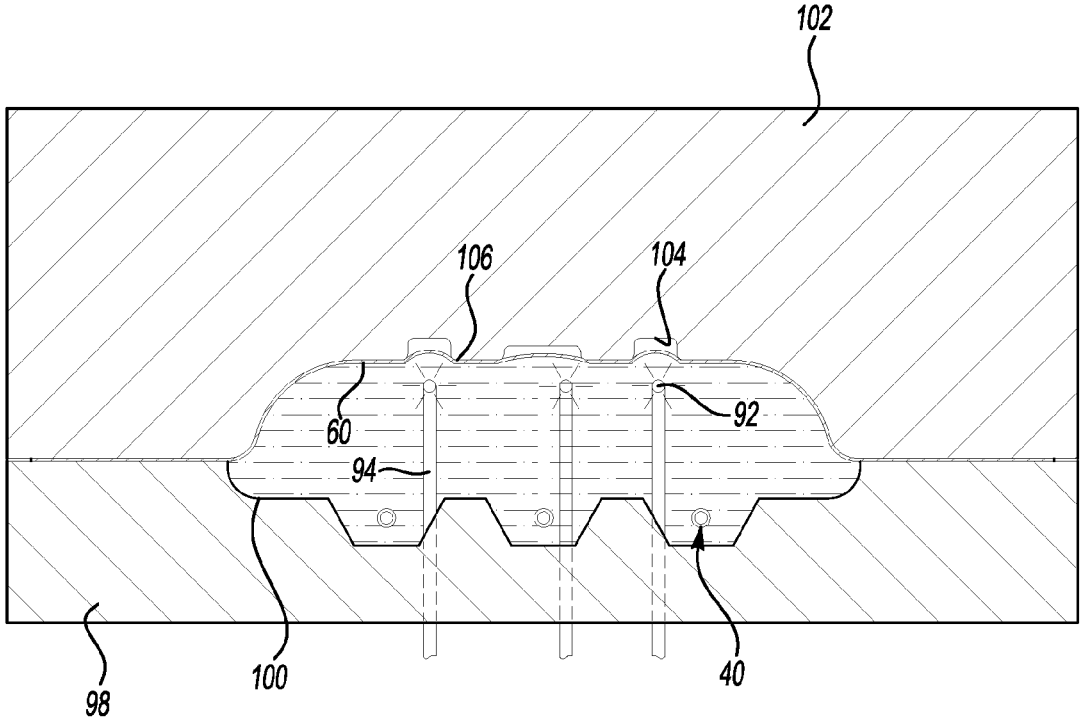

Referring to FIG. 7, the partially formed part 60 is shown after discharge of the gap discharge electrode assembly 40 in FIG. 6. In FIG. 7, the upper tool 102 is shown engaging the lower tool 98. The wire electrode 92 is shown in an extended position wherein the electrode rod 96 (not shown in FIG. 7) lifts the wire electrode holder 94 and the wire electrodes 92 in an extended position adjacent to the partially formed part 60. Detail areas 106 are spaced from the die surface 104 and are part of the partially formed part 60. The wire electrodes 92 are preferably located close to the detail areas 106 to concentrate the electro-hydraulic forming discharge that is provided by discharging the wire electrode 92.

Figure 8:
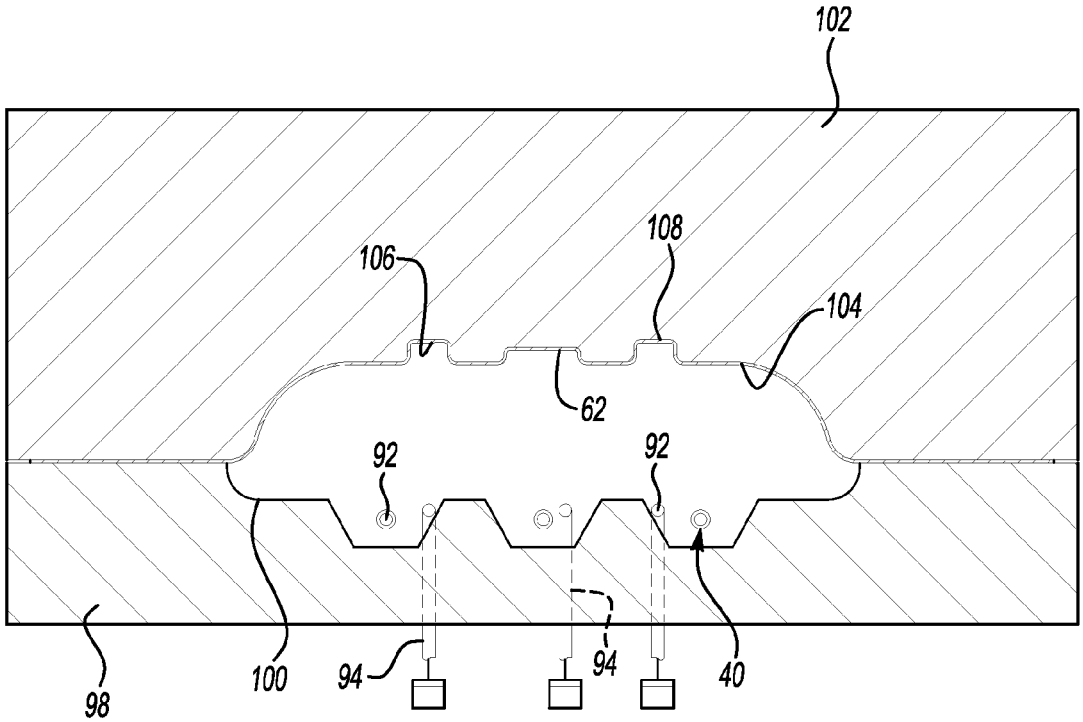

Referring to FIG. 8, the fully formed part 62 is shown fully formed and in engagement with the die surface 104. The detail areas 106 are distinctly formed by the discharge of the wire electrode that are in close proximity to the die surface 104 as a result of the advancement of the wire electrodes by the electrode rods 96 shown in FIG. 5. At this point in the forming process, the fluid has been drained from the chamber 100, and the upper and lower tools 102 and 98 may be separated to remove the fully formed part 62 from the chamber 100. At this point, the wire electrode holders 94 shown in FIG. 7 are retracted to lower the wire electrodes 92 toward the lower tool 98.

Figure 9:
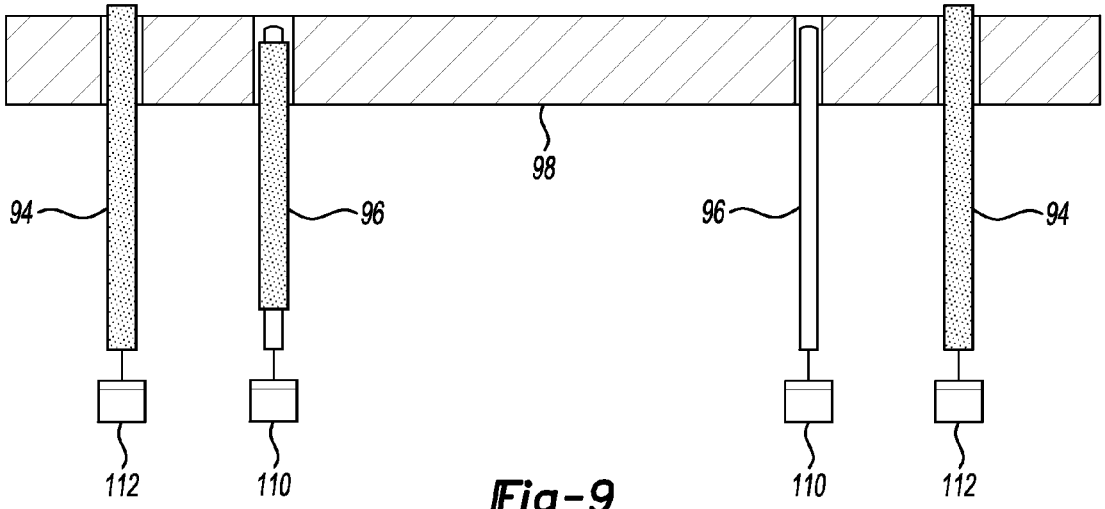
FIGS. 9 and 10 are diagrammatic sequential views showing the position of the wire holders and electrodes in an initial position and a raised position.
Figure 10:
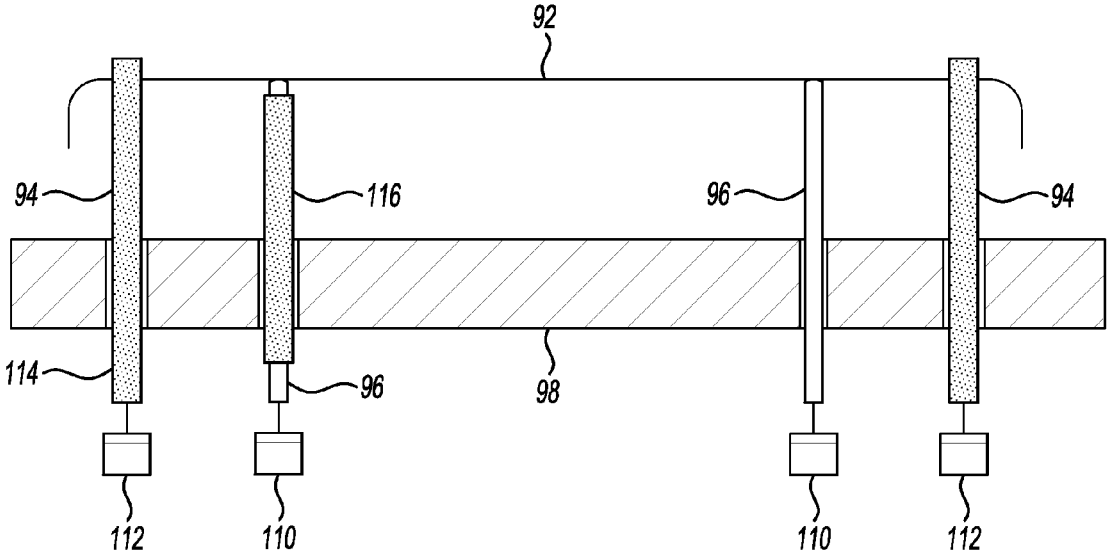

Referring to FIGS. 9 and 10, one embodiment of an apparatus for practicing the wire discharge process is illustrated in which a wire electrode 92 is shown in FIG. 10 that is retained by wire electrode holders 94. The wire electrode 92 may be tied, clamped or otherwise secured to the ends of the wire electrode holders 94. Electrode rods 96 lift the wire electrode 92 by engaging it from below and also connect the wire electrode 92 to the source of stored charge. The wire electrode holders 94 and electrode rods 96 extend through the lower tool 98 and are moved by hydraulic cylinders 110 and 112. Cylinders 110 operatively engage electrode/lifers 96 and cylinders 112 engage wire electrode holders 94. In FIG. 9, the wire electrode holders 94 and electrode/lifers 96 are retracted without having a wire electrode 92 installed. FIG. 10 shows the wire electrode 92 in place in the wire electrode holders 94. The electrode rods 96 are shown lifting the wire electrode 92 to a position closer to the surface to be formed which increases the intensity of the EHF discharge against a blank or preform, as shown in FIGS. 5-8 above. By locating the electrode rods 96 inboard of the wire electrode holders, the wire electrode does not weld or melt onto the wire electrode holders 94. Each of the wire electrode holders 94 has insulation 114 to prevent grounding. The electrode/lifer 96 on the left side of FIGS. 9 and 10 has insulation 116, while the electrode rod 96 on the right side of FIGS. 9 and 10 is not insulated and is the grounded electrode.

While the best mode for carrying out the invention has been described in detail, those familiar with the art to which this invention relates will recognize various alternative designs and embodiments for practicing the invention as defined by the following claims.

What is claimed:

1. A method for electro-hydraulically forming a sheet metal part in an electro-hydraulic forming (EHF) machine comprising:

supplying a first volume of liquid to a chamber of the EHF machine;

placing the part that is in a first shape in the EHF machine between a one-sided forming die and a chamber that is then completely filled with a second volume of liquid to the part;

discharging an electrode in the chamber to form the part toward the forming die and form the part into a second shape;

supplying a third volume of liquid to a chamber;

advancing the electrode within the chamber toward the part; and discharging the electrode in the chamber to form the part toward the forming die and form the part into a third shape.

2. The method of claim 1 further comprising forming the part into the first shape in a process selected from the group comprising:

mechanical press forming, hydro-forming, and electro-hydraulic forming.

3. The method of claim 1 further comprising in the first discharging step discharging a stored charge source across a gap between two spaced electrodes of a gap electrode EHF machine.

4. The method of claim 3 further comprising in the second discharging step, discharging a stored charge source across a gap between two spaced electrodes of the gap electrode EHF machine.

5. The method of claim 3 further comprising in the second discharging step, discharging a stored charge source across a wire electrode of a wire electrode EHF machine.

6. The method of claim 1 further comprising refilling the chamber after the discharging step and after the step of advancing the electrode.

* * * * *